US007909633B1

(12) United States Patent
Miller et al.

(10) Patent No.: US 7,909,633 B1
(45) Date of Patent: Mar. 22, 2011

(54) WIRE CONNECTION APPARATUS

(75) Inventors: Arlyn E. Miller, Leander, TX (US); Kent A. Burr, Round Rock, TX (US); Russell W. Read, Round Rock, TX (US); Steven K. Brown, Austin, TX (US)

(73) Assignee: Fisher-Rosemount Systems, Inc., Austin, TX (US)

( * ) Notice: Subject to any disclaimer, the term of this patent is extended or adjusted under 35 U.S.C. 154(b) by 0 days.

(21) Appl. No.: 12/560,300

(22) Filed: Sep. 15, 2009

(51) Int. Cl.
*H01R 13/648* (2006.01)

(52) U.S. Cl. ..... 439/441; 439/815; 439/620.26

(58) Field of Classification Search ..... 439/810–815, 439/709, 441, 620.26
See application file for complete search history.

(56) References Cited

U.S. PATENT DOCUMENTS

| | | | | |
|---|---|---|---|---|
| 4,172,628 | A * | 10/1979 | Lingaraju | 439/441 |
| 4,392,707 | A * | 7/1983 | Holce et al. | 439/573 |
| 4,530,558 | A * | 7/1985 | Reimer | 439/55 |
| 5,192,234 | A | 3/1993 | Heng et al. | |
| 5,249,989 | A | 10/1993 | Alsch | |
| 5,669,788 | A | 9/1997 | Brockman | |
| 6,270,384 | B2 | 8/2001 | Jaag | |
| 7,029,336 | B2 | 4/2006 | Cox | |
| 7,101,231 | B2 | 9/2006 | Prokup et al. | |
| 7,115,001 | B1 | 10/2006 | Brockman et al. | |
| 7,140,887 | B2 * | 11/2006 | Poh et al. | 439/107 |
| 7,347,739 | B2 | 3/2008 | Cox | |
| 7,544,103 | B2 * | 6/2009 | Walter et al. | 439/709 |

FOREIGN PATENT DOCUMENTS

EP 1 134 842 A2 9/2001

* cited by examiner

*Primary Examiner* — Gary F. Paumen
(74) *Attorney, Agent, or Firm* — Marshall, Gerstein & Borun LLP

(57) ABSTRACT

A terminal wire block includes a spring clamp and a screw clamp to hold an electrical wire in a fixed position using one or both of the clamps. The spring clamp includes a cage and a spring to push the wire against one of the walls of the cage. The screw clamp includes an externally threaded fastener such as a screw to hold the wire in place when the fastener is tightened. One or both of the spring clamp and the screw clamp may be operated independently of the other one of the spring clamp and the screw clamp. When operated together, the spring clamp and screw clamp provide additional integrity and security to the contact.

31 Claims, 6 Drawing Sheets

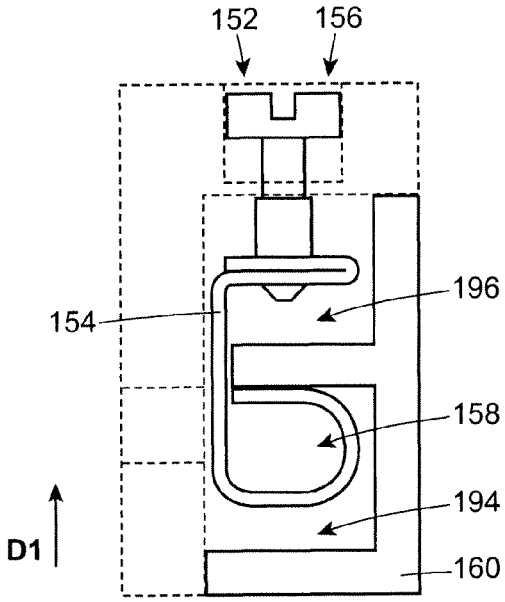
FIG. 8
FIG. 10
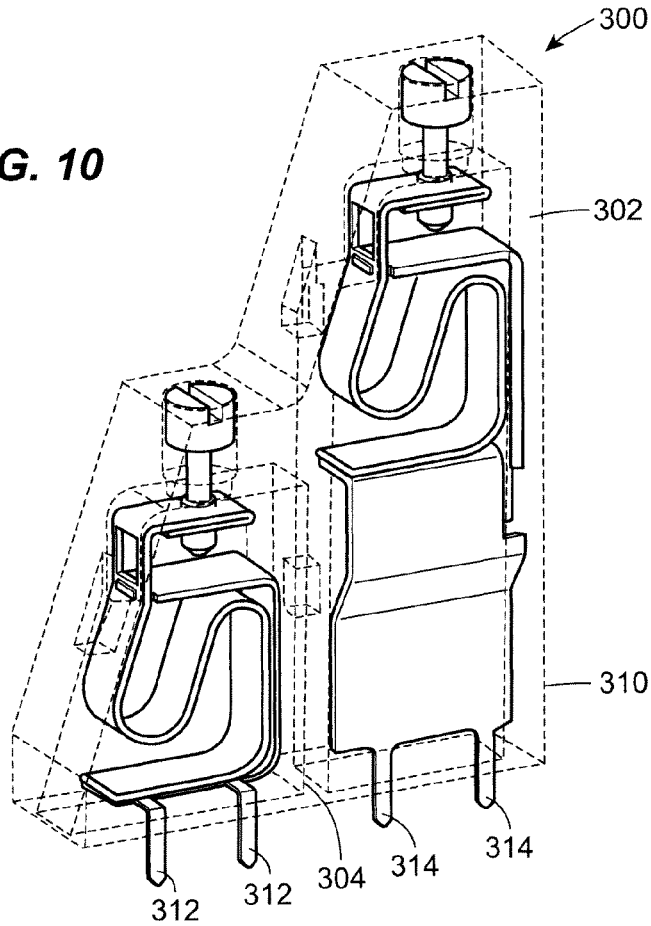

WIRE CONNECTION APPARATUS

FIELD OF THE DISCLOSURE

The present disclosure relates generally to electrical wiring and, in particular, to a convenient terminal wire block.

TECHNICAL BACKGROUND

Terminal wire blocks are widely used to connect electrical wires to printed wiring boards (PWBs) or printed circuit boards (PCBs), to securely couple pairs of wires, and to otherwise provide reliable electrical contacts. In general, it is known to use either spring clamps or screw clamps as terminal wire blocks to secure electrical wires in a fixed position.

Spring wire clamps typically include a housing and a spring (or a similar elastic component) to which a force is manually applied as a wire is inserted into the clamp. Once released, the spring exerts a force on the wire to push the wire against one of the walls of the housing. It is also known to install an elastic element on the wire to interact with a clamp housing of a standard size. For example, a typical personal computer includes a cage terminal to receive an Ethernet cable that includes a flexible plastic strip, bent to define an acute angle, at one or both ends. The plastic strip and the cage terminal together define a push-in terminal that does not require screws, bolts, or other fasteners.

By contrast, screw clamps typically include a housing and an externally threaded fastener such as a screw operatively connected to the housing. A technician places a wire inside the housing and tightens the fastener to push the wire against one of the walls of the housing. Accordingly, screw clamps usually require the use of a tool such as a screwdriver.

Some technicians prefer spring clamps while others prefer screw clamps. In addition to personal preferences, certain applications make spring clamps preferable because spring clamps normally do not require special tools or room to maneuver such tools. Moreover, spring clamps typically are better suited for connecting wires on or adjacent to vibrating devices, as threaded connections (e.g., a screw and a nut) tend to loosen in response to vibration. On the other hand, spring clamps may include easily breakable components such as plastic strips, or may age faster as springs or similar flexible components lose rigidity or elasticity.

SUMMARY

A terminal wire block includes two independently operable wire clamps for securing a wire in a fixed position. In at least some of the embodiments, the two independently operable wire clamps use different mechanisms, such as a spring mechanism and a screw mechanism, to hold the wire in place.

In an embodiment, the terminal wire block includes a screw clamp and a spring clamp positioned behind the screw clamp, so that an exposed end of the wire first passes through the screw clamp to reach the spring clamp. The spring clamp includes a cage and a flexible spring finger biased toward one of the walls of the cage, so that the spring finger must be bent to allow the wire to reach the inside of the cage. By contrast, the screw clamp includes a cage with a threaded opening and an externally threaded fastener to mate with the opening of the cage to define a narrower or wider opening in the direction of movement of the wire through the cage in response to tightening or loosening the externally threaded fastener, respectively.

To insert a wire into the spring clamp, a technician pushes an exposed end of the wire through the screw clamp to reach the flexible spring finger, and applies sufficient pressure to the wire to displace one end of the spring finger relative to its equilibrium position, and allow the wire to reach the inside of the cage of the spring clamp. When the technician stops applying pressure to the wire, the spring finger pushes the wire toward one of the walls of the cage and thereby secures the wire in a fixed position.

Optionally, the technician subsequently tightens the externally threaded fastener of the screw clamp to hold the wire more firmly in place and thus provide additional integrity to the corresponding electrical contact. As another option, the technician uses only the screw clamp. In this case, the technician pushes the wire inside the cage of the screw clamp but not far enough, or with a sufficient force, to displace the spring finger.

To remove the wire from the terminal wire block when only the screw clamp is engaged, the technician loosens the externally threaded fastener and pulls out the wire. To remove the wire from the terminal wire block when both the spring clamp and the screw clamp are engaged, the technician may also operate a push down button which applies pressure to the spring finger in the direction opposite to the bias of the spring finger, or reach the spring finger with a tool such as a screwdriver via a corresponding opening.

In some embodiments, a terminal wire block with a small foot print includes a spring clamp having a spring and a screw clamp having a fastener operatively connected to the spring, so that the spring is deflected in response to pressure applied to the fastener. Once the spring clamp secures a wire in a fixed position, a technician may also engage the screw clamp by threading or otherwise tightening the fastener. In at least some of the embodiments in which the fastener is adapted to communicate pressure to the spring, the spring clamp and the screw clamp share a common cage. Further, the spring in some embodiments may have a first bias in a direction opposite to the direction in which the fastener is threaded, and a second bias approximately perpendicular to the first bias to better guide pressure applied to the fastener.

In some embodiments, multiple terminal wire blocks, each having a spring clamp and a screw clamp, are aligned on a circuit board to define a multiple-input connector or a connector array. In one such embodiment, multiple terminal wire blocks form several rows, with the back rows being progressively elevated relative to the front rows to provide convenient and secure access to each terminal wire block.

DETAILED DESCRIPTION OF THE DRAWINGS

FIG. 8 is a side view of the terminal wire block of FIG. 6.

FIG. 10 is a perspective view of a wire connector that includes two instances of the terminal wire block of FIG. 9, arranged in respective upper and lower rows.

DETAILED DESCRIPTION

Figure 1:
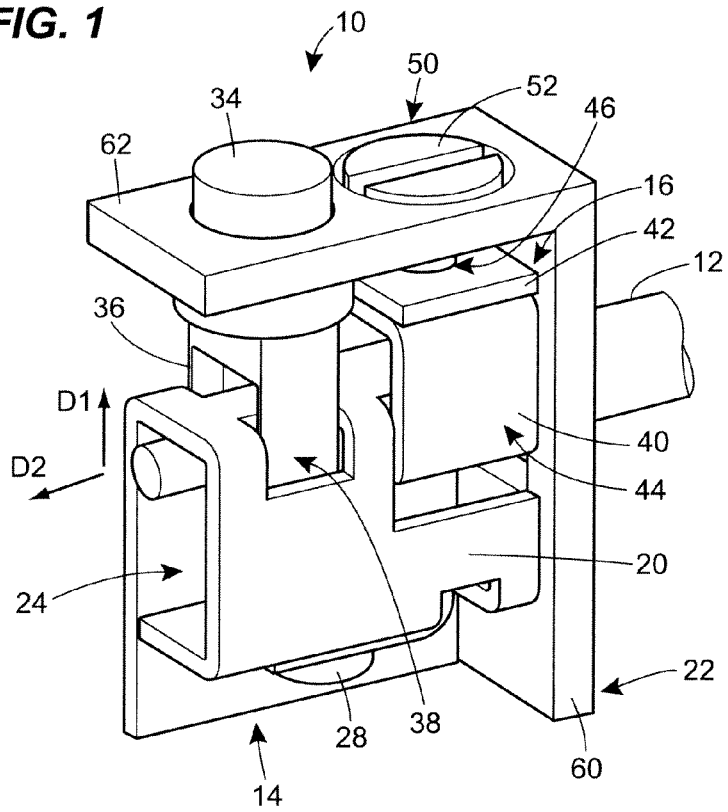
FIG. 1 is a perspective view of a terminal wire block having two independently operable clamps.

FIGS. 1-4 illustrate an example of a terminal wire block 10 for securing an electrical wire 12 in a fixed position using one or both of two independent mechanisms to complete an electrical contact, for example. In particular, the terminal wire block 10 includes a spring clamp 14 and a screw clamp 16 so that the wire 12 may be secured using only the spring clamp 14 or only the screw clamp 16. However, if desired, a technician may also secure the wire 12 using both of the clamps 14 and 16 to provide additional integrity and security to the electrical contact.

The terminal wire block 10 may include a terminal base 20 and an external cover 22. In general, the terminal base 20 may be mounted on a horizontal, vertical, or inclined surface. In some embodiments, the terminal base 20 may be soldered to a circuit board or another component. Alternatively, the terminal base 20 may include one or several pins (not shown) for mounting on the circuit board. The terminal base 20 may be manufactured from a rigid non-conductive material such as plastic, for example. However, the terminal base 20 in other embodiments may be made of metal or another conductive material. In addition to fulfilling the structural functions discussed in more detail below, a conductive terminal base 20 may serve as a conductive path between the wire 12 and another electrical contact such as a wire or a circuit board contact.

In the embodiment of FIGS. 1-4, the terminal base 20 is a relatively thin sheet with a section bent or molded to define a cage 24 of the spring clamp 14. A flexible spring finger 26 (best shown in FIG. 4) is disposed inside the cage 24 and is biased in the direction $D_1$, i.e., toward the upper wall of the cage 24. More specifically, the spring finger 26 is sloped opposite to a direction $D_2$ in which the wire 12 enters the terminal wire block 10, so that the wire 12 bends the spring finger 26 toward the bottom wall of the cage 24 (i.e., opposite to the direction $D_1$) when entering the spring clamp 14. The finger spring 26 thus defines a mechanical push-in terminal of the terminal wire block 10. Once the wire 12 is inside the cage 24, the spring finger 26 pushes the wire 12 toward the upper wall of the cage 24. Thus, when pressure is no longer applied to the spring finger 26 by way of the wire 12 in the direction $D_2$, the spring clamp 14 holds the wire 12 securely in place.

The spring finger 26 generally may be manufactured using a resilient material having a memory, so that the spring finger 26 has a tendency to return to its original shape once deformed. In an embodiment, the spring finger 26 is also conductive to provide an electric contact between the wire 12 and another wire or the cage 24, for example. To this end, the spring finger 26 may be made of a metal or alloy.

Figure 4:
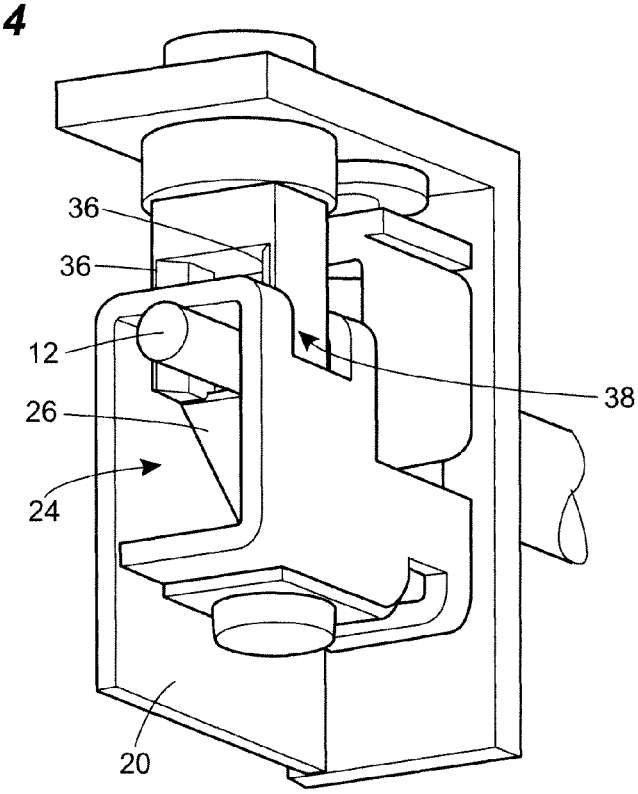
FIG. 4 is another perspective view of the terminal wire block of FIG. 1.

As best illustrated in FIG. 4, the spring finger 26 may be welded, soldered, glued, or otherwise fastened to the bottom wall of the cage 24 at a contact point 28. Further, in the embodiments including a conductive spring finger 26, an exposed section of a second electrical wire (not shown) may be fastened to the spring finger 26 at the contact point 28 to complete a current path between the wire 12 and the second wire. In other embodiments, the spring finger 26 may be soldered directly to the circuit or wire board on which the terminal base 20 resides.

To release the wire 12 held by the spring clamp 14, a push button 34 is operated to apply pressure to the spring finger 26 via a pair of actuating levers or legs 36 in the direction opposite to $D_1$. In other embodiments, the spring clamp 14 may not include the push button 34 at all, and a technician may apply pressure directly to the spring finger 26 using a screwdriver or another suitable tool, for example. Once the spring finger 26 is depressed, the wire 12 can be easily pulled out of the spring clamp 14. The cage 24 accordingly includes a pair of openings 38 to receive the respective legs 36.

The screw clamp 16 is disposed in front of the spring clamp 14 relative to the opening through which the wire 12 in inserted into the terminal wire block 10. In other words, the wire 12 passes through the screw clamp 16 to reach the spring clamp 14. In the embodiment illustrated in FIGS. 1-4, the screw clamp 16 includes a U-shaped bracket 40 and an L-shaped bracket 42 that define a cage 44 (best shown in FIG. 2). The brackets 40 and 42 include respective aligned openings 46 to receive a fastener 50 having a head 52 and a work end 54. In general, the fastener 50 may be of any desirable type, and the head 52 accordingly may be selected to mate with a single-blade, Phillips, Allen, or any other type of a screwdriver. The work end 54 is preferably flat to avoid damaging the wire 12, although fasteners with non-flat or even sharp work ends also may be used.

If the fastener 50 is a screw, a bolt, or another type of a fastener with an external threaded surface, the internal surface of each of the openings 46 may include corresponding threads. The fastener 50 may thus couple the brackets 40 and 42 to each other, as well as serve as an actuating element of the screw clamp 16. Of course, it is also possible to provide the cage 44 as an integral element which, in turn, may also may be integral with other components of the terminal wire block 10.

To engage the screw clamp 16 when the wire 12 is inside the terminal wire block 10, a technician may tighten the fastener 50 to thereby reduce the distance between the work end 54 and the bottom wall of the cage 44. In this manner, the screw clamp 16 applies pressure to the wire 12 in the direction opposite to $D_1$. To evenly distribute pressure applied to the wire 12, and to prevent damage to the threads of the wire 12, a plate 56 may be attached to the work end of the fastener 50. The technician may release the wire 12 from the screw clamp 16 by loosening the fastener 50 (i.e., by driving the work end 52 in the direction $D_1$).

It will be noted that the spring clamp 14 may be operated independently of the screw clamp 16. In other words, a technician may push the wire 12 through the cage 44 to engage the push-in terminal of the spring clamp 14. Once engaged, the spring clamp 14 will hold the wire in place irrespective of the position of the fastener 50. Alternatively, the technician may choose not to push the wire 12 through to the spring clamp 14 and may engage only the screw clamp 16. As yet another alternative, the technician may engage both the spring clamp 14 and the screw clamp 16 if additional contact integrity or security is desired. In this case, the clamps 14 and 16 apply pressure to the wire 12 along the direction $D_1$ and in the direction opposite to $D_1$, respectively, thereby providing a tight and secure connection.

In the embodiment illustrated in FIGS. 1-4, the external cover 22 is a bracket having a front plate 60 with an opening to receive the wire 12, and an upper plate 62 with two openings to receive the push button 34 and the fastener 50, respectively. The plates 60 and 62 may be perpendicular to each other. If desired, the external cover 22 may be made of a less durable material than the terminal base 20.

Figure 3:
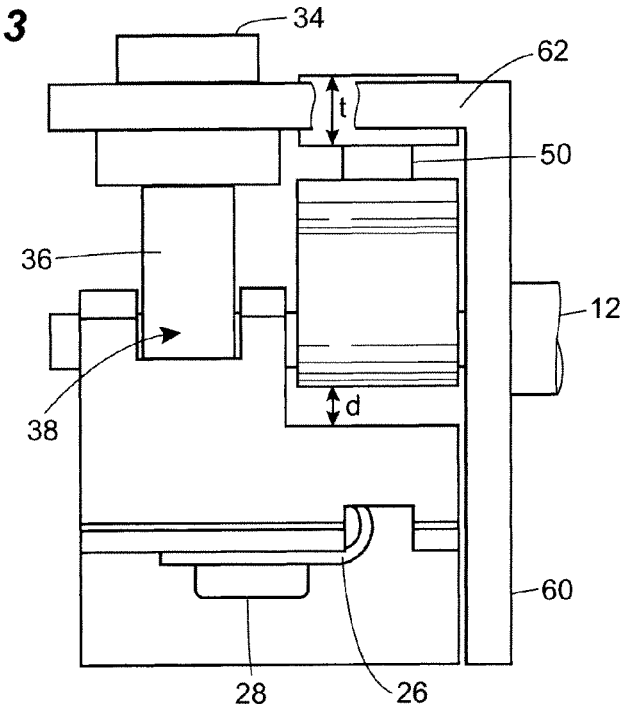
FIG. 3 is a side view of the terminal wire block of FIG. 1.

In an embodiment, the head 52 of the fastener 50 may be shaped so as to retain the cage 44 in a fixed position within the terminal wire block 10 without rigidly securing one or both of the brackets 40 and 42 to the terminal 20. As best illustrated in FIG. 3, the thickness t of the head 52 may be greater than the distance d between the bottom of the cage 44 and a corresponding section of the terminal base 20. It is thus possible to loosely connect the cage 44 to other components of the terminal wire block 10, thus simplifying the manufacture and assembly of the terminal wire block 10.

It is also possible to provide a single component (e.g., an extended terminal base) in which the terminal base 20 is integral with the cage 44. Further, if such an extended terminal base is manufactured from a conductive material, and if the spring finger 26 is soldered to the extended terminal base, the cage 44 may be at the same electric potential as the contact point 28. In this manner, the terminal wire block 10 may electrically connect the wire 12 to an electrical wire connected at the contact point 28 even if only the screw clamp 16 is engaged. Alternatively, an electrical wire may be connected to the screw clamp 14 at the top of the cage 44.

Generally speaking, some or all of the components of the terminal wire block 10 may be manufactured using metal extrusion, injection molding of plastic, cutting and bending of sheet metal, or any other suitable techniques. The selection of suitable material for some of these components may depend on the desired electrical connections within the terminal wire block 10. For example, it may be necessary to manufacture the terminal base 20 from a metal or metal alloy if the terminal base 20 serves as a conductive path between the wire 12 and another wire or the PWB.

Figure 2:
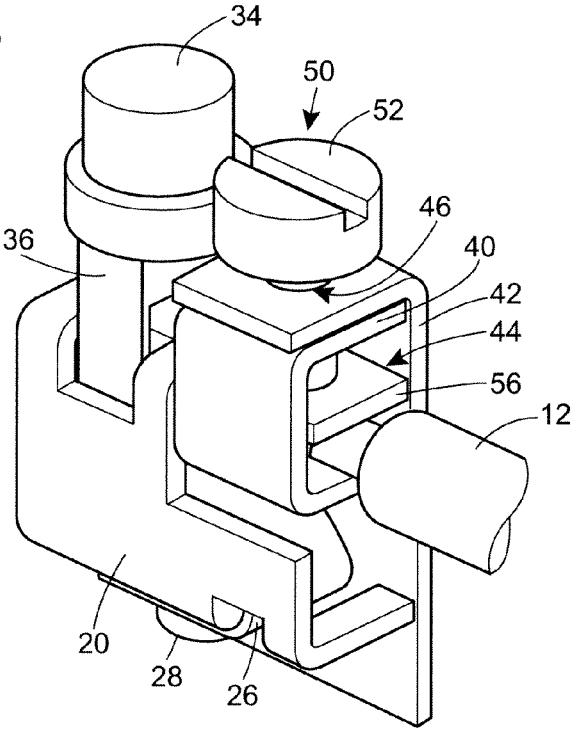
FIG. 2 is another perspective view of the terminal wire block of FIG. 1 with a cover removed.

In one embodiment, the terminal wire block 10 is compatible with a 0.2" terminal pitch, and the wire 12 is in the range between the No. 24 American Wire Gauge (AWG) stranded (i.e., measured along the cross-sectional area of the conductive strands) wire to 12 AWG solid core wire. As best illustrated in FIGS. 1 and 2, the terminal wire block 10 receives an exposed end of the insulated wire 12. Of course, the terminal wire block 10 generally may be manufactured in compliance with any desired terminal pitch, wire size, circuit board standard, etc.

It will be appreciated that the terminal wire block 10 is discussed above by way of example only. Several additional features and alternatives to the embodiment of FIGS. 1-4 are discussed below. In general, a terminal wire block having at least two independently operable clamps may include none, one, or several of these features.

In one aspect, it is not necessary for the fastener 50 to apply pressure to the wire 12 in the direction opposite to $D_1$. As one alternative, the screw clamp 16 may push the wire 12 in the direction $D_1$ when the technician tightens the fastener 50. In another alternative, the screw clamp 16 may be positioned so as to direct the pressure from the fastener 50 perpendicularly to both $D_1$ and $D_2$. Other orientations of the screw clamp 16 and/or the fastener 50 are also possible.

Further, the spring clamp 14 may include a biasing element other than the spring finger 26. For example, the biasing element may be a spring, a coil, or another flexible element. Also, the biasing element may be biased in any direction other than $D_1$ that results in the wire 12 being pressed against a wall of the corresponding cage and thereby being held in place.

Still further, the fastener 50 in another embodiment may be combined with the push button 34 to reduce the foot print of the terminal wire block 10. The spring clamp 14 and the screw clamp 16 may accordingly share a cage to hold the wire 12. However, the respective mechanisms of the clamps 14 and 16 are preferably independently operable. For example, the head 52 of the push button 34 may include an aperture, and the push button 34 may include an internal threaded surface, to receive and mate with the external threads of the fastener 50 along the direction $D_1$.

In yet another aspect, a terminal wire block similar to the terminal wire block 10 may include more than two wire clamps implementing different wire clamping techniques, with at least two of the wire clamps being independently operable.

Also, the spring clamp 14 in some embodiments may be disposed in front of the screw clamp 16 relative to the opening through which the wire 12 in inserted into the terminal wire block 10. To reach the cage 44 of the screw clamp 16, the wire 12 may be pushed against and past the spring finger 26 of the spring clamp 14. Thus, in this embodiment, the spring clamp 14 may be engaged automatically when the wire 12 is secured using the screw clamp 16.

Figure 5:
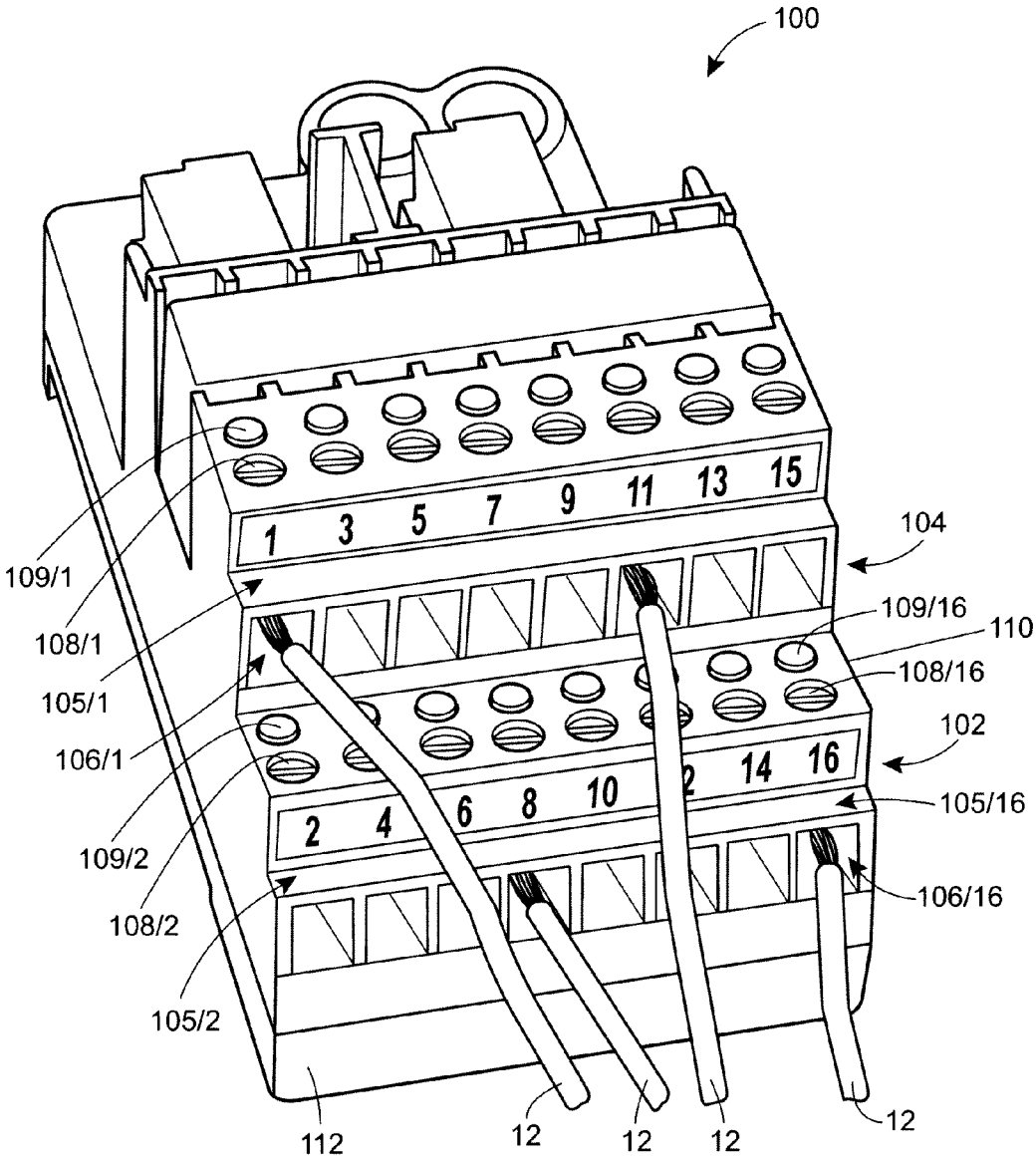
FIG. 5 is a perspective view of a wire connector in which several instances of the terminal wire block of FIG. 1 are arranged in a two-row array.

Referring to FIG. 5, multiple terminal wire blocks identical or similar to the terminal wire block 10 may define a multiple-input connector 100. In this example, the multiple-input connector 100 includes a front row 102 and an elevated back row 104, each having eight openings 105/1, 105/2, . . . 105/16 into respective wire terminals, which together define a set of wire terminals 106/1, 106/2, . . . 106/16. The elevation of the back row 104 relative to the front row 102 provides convenient access to the wire terminals of the back row 104. Each of the wire terminals includes a spring cage with a corresponding push button 109/1, 109/2, . . . 109/16 and a screw cage with the head of a fastener accessible via a corresponding opening 108/1, 108/2, . . . 108/16. The multiple-input connector 100 may be enclosed in a protective housing 110 with a base 112 mountable on a circuit or wire board, or on any other surface.

Figure 6:
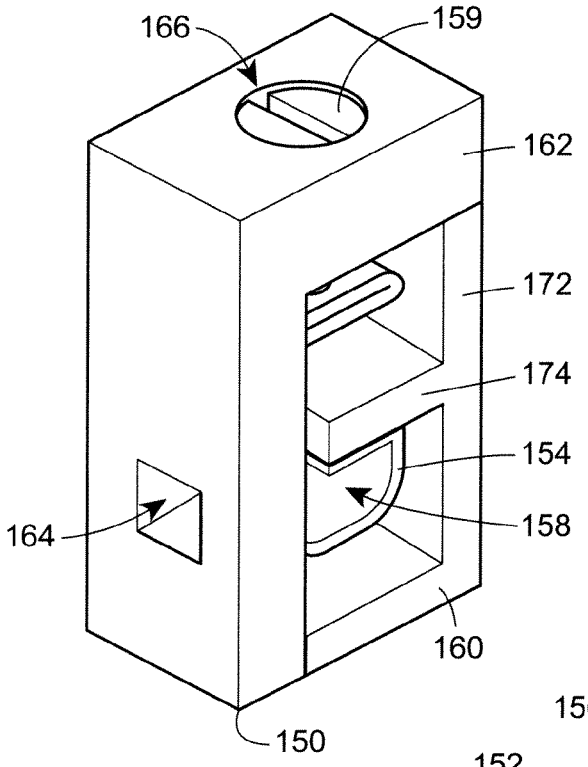
FIG. 6 is a perspective view of a terminal wire block in which a fastener is combined with a push button.
Figure 7:
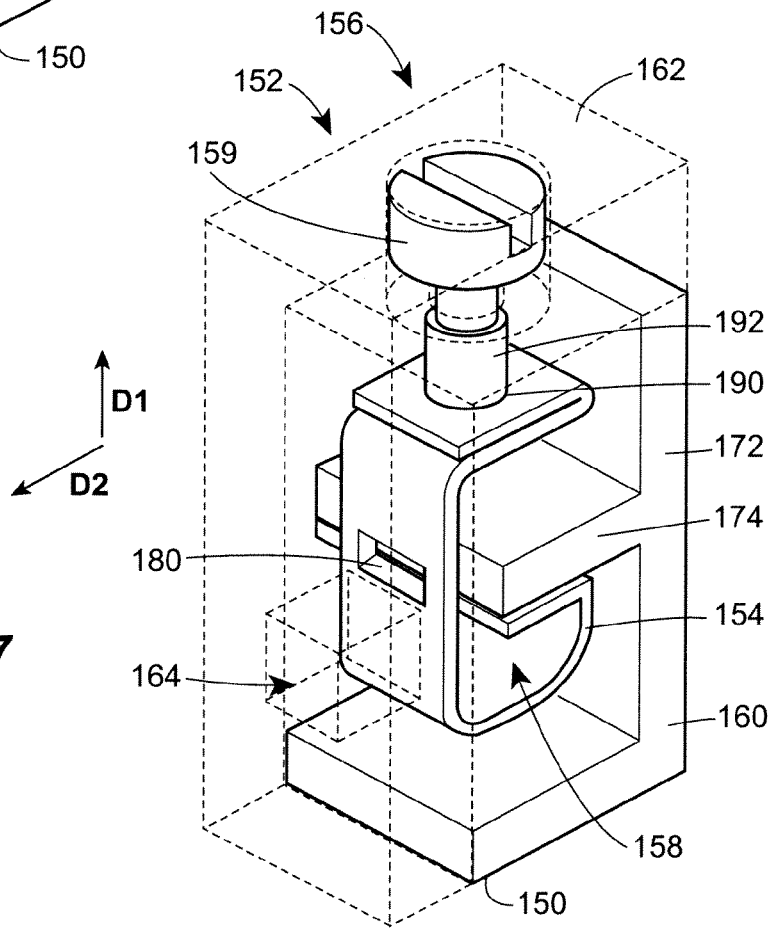
FIG. 7 is another perspective view of the terminal wire block of FIG. 6 with a cover removed.

FIG. 6 illustrates a terminal wire block 150 that includes a spring clamp 152 and a screw clamp 156 that share a common cage 158 (best shown in FIG. 7). In this embodiment, the spring clamp 152 includes a spring 154, and the screw clamp 156 includes a fastener 159 through which a technician may apply pressure to the spring 154. Thus, in a sense, the fastener 159 has respective functions in both the spring clamp 152 and the screw clamp 156.

With continued reference to FIG. 6, the terminal wire block 150 may include a terminal base 160 and an L-shaped cover 162 with an opening 164 through which a wire may enter the terminal wire block 150, and another opening 166 through which a tool such as a screwdriver may access the fastener 159. As explained in more detail below, a technician can actuate the spring 154 via the opening 166 and the fastener 159. As compared to the embodiment discussed with reference to FIGS. 1-4, the terminal wire block 150 has a smaller foot print and requires fewer parts. Moreover, the terminal wire block 150 allows a technician to operate each of the spring clamp 152 and the screw clamp 156 using the same screwdriver (or another suitable tool).

As best illustrated in FIG. 7, the base 160 may be shaped as a capital letter "F" with a vertical support wall 172 and a middle shelf 174 to which the spring 154 may be soldered, glued, or otherwise fastened. The spring 154 may be, for example, a flat spring shaped as a capital letter "G", with the inward protrusion aligned with the middle shelf 174, and the loop section below the inward protrusion defining the cage 158. The spring 154 includes an opening 180 approximately at the level of the middle shelf 174 through which an exposed end of a wire can enter the cage 158 in some operational states of the spring clamp 152. In some embodiments, the width and the height of the opening 180 may be similar to the width and the height of the opening 164. However, because the spring 154 is biased in the direction of $D_1$, i.e., away from the cage 158, the openings 180 and 164 are not aligned unless pressure is applied to the spring 154. When a technician actuates the spring 154 by applying pressure to the fastener 159, the opening 180 moves downward (i.e., in the direction opposite to $D_1$) so that the openings 180 and 164 become aligned, and an end of a wire can enter the cage 158. The technician may then stop applying pressure to the fastener 159, and the spring 154 clamps the wire by pressing the wire in the direction $D_1$ against the edge of the middle shelf 174 and, in some embodiments, the inner wall of the cover 162.

Similar to the spring finger 26 discussed with reference to FIGS. 1-4, the spring 154 may be made of a resilient material having a memory. By contrast, the base 160 may be relatively rigid so as to display little or no deflection in response to pressure applied to the spring 154. In other words, the positioning of each part of the base 160 relative to the opening 164 is preferably the same in all operational states of the terminal wire block 150.

Once the spring clamp 152 secures the wire in a fixed position, the technician sometime may wish to also engage the screw clamp 156 to provide additional integrity and security to the contact. In this embodiment, the spring 154 includes an internally threaded opening 190 in the portion corresponding to the upper tail of the letter "G" with which the fastener 159 may mate. A sleeve or guide 192 may be rigidly secured to the spring 154 at the opening 190 to properly guide the fastener 159. In another aspect, the sleeve 192 may help to distribute the pressure applied to the spring 154 via the fastener 159 when the spring clamp 152 is being engaged.

When the technician threads or otherwise tightens the fastener 159, the loop section of the spring 154 contracts, thereby increasing the pressure the spring 154 exerts on the wire in the direction $D_1$, and thus improving the integrity and security of the contact. To release the wire, the technician may loosen the fastener 159 to first disengage the screw clamp 156, and then apply pressure to the fastener 159 to align the openings 180 and 164 until the wire can be released.

FIG. 8 illustrates a side view of the terminal wire block 150. As best illustrated in this drawing, the base 160 defines two sufficiently large cavities 194 and 196 in the lower and upper sections of the base 160, respectively, to allow the corresponding sections of the spring 154 to freely move when pressure is applied to the fastener 159, or when the technician tightens the fastener 159.

It is noted that some technicians may inadvertently release the wire held by the spring clamp 152 when operating the screw clamp 156. In particular, the technician must apply little pressure to the fastener 159 in the direction opposite to D1 when tightening the fastener 159, e.g., by threading the work end of the fastener 159 in the clockwise direction if the fastener 159 is a screw, a bolt, or another type of an externally threaded fastener.

Figure 9:
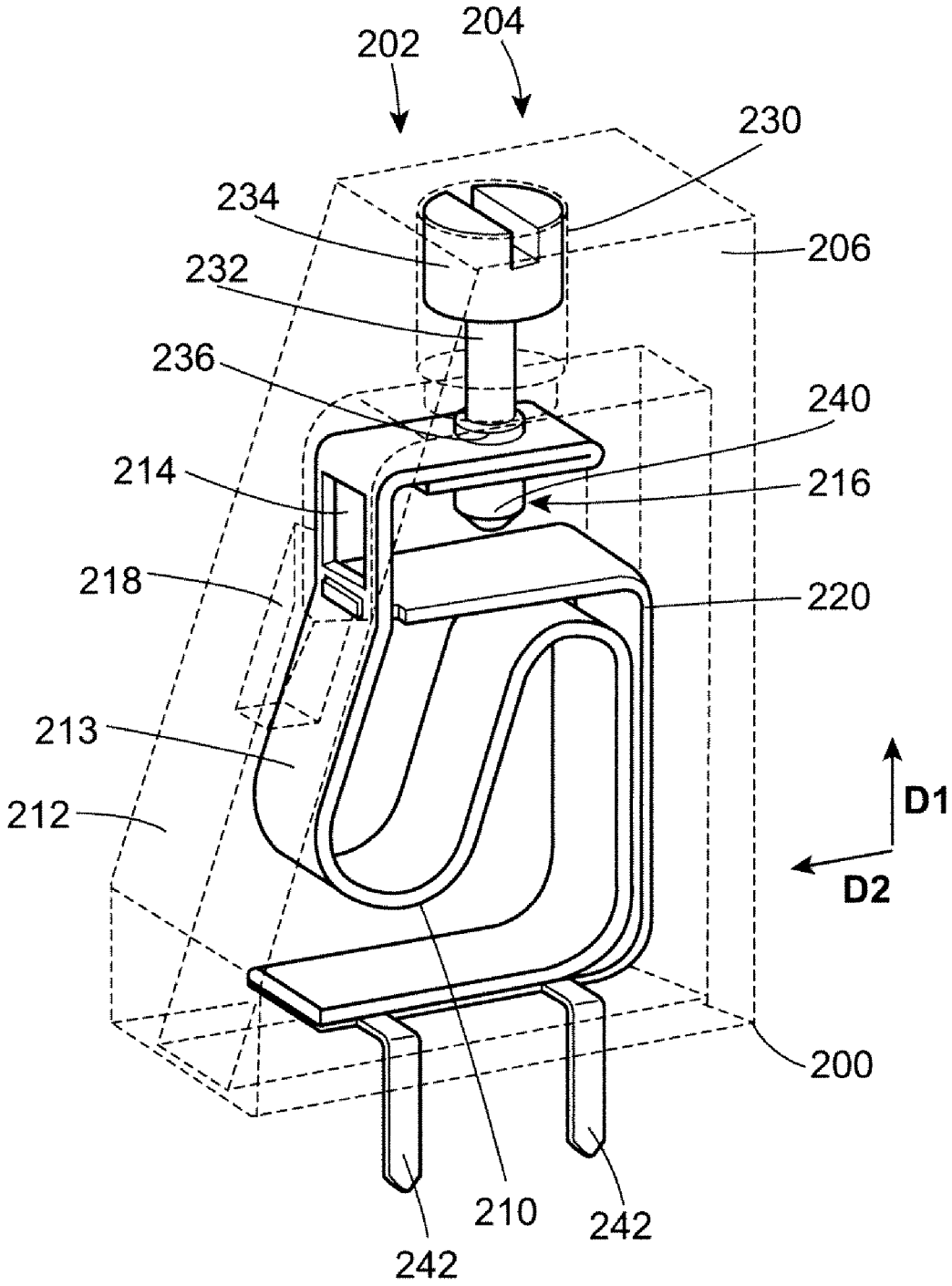
FIG. 9 is a perspective view of another embodiment of a terminal wire block in which a fastener is combined with a push button.

Now referring to FIG. 9, a terminal wire block 200 with a spring clamp 202, a wire clamp 204, and a housing 206 reduces the probability of accidental release of the wire by biasing a spring 210 of the spring clamp 202 both against an upper section of the housing 206 and against an inclined wall 212 of the housing 206. The arrows indicating the directions $D_1$ and $D_2$ schematically illustrate the respective directions of the two biases. It is noted that the bias in the direction $D_1$ is largely similar to the bias of the spring 154 of FIGS. 6-8. It is also noted that the direction $D_2$ is depicted only approximately, and that the direction $D_2$ need not be orthogonal to $D_1$. Generally speaking, $D_2$ may be selected so that the spring 210 exerts at least some pressure on the inclined wall 212 when pressure is applied to the spring 210 in the direction opposite to $D_1$.

In the example embodiment illustrated in FIG. 9, the spring 210 is shaped as a letter "s" with another letter "s", rotated 90 degrees, inscribed into the middle section and bent so as to align with the inclined wall 212. In particular, a section 213 of the spring 210 may be parallel to the inclined wall 212 to provide friction between the section 213 and the inclined wall 212 when the spring 210 is compressed in the direction opposite to $D_1$. The spring 210 may also include an opening 214 through which a wire may enter a cage 216 if the spring 210 is sufficiently compressed in the direction opposite to $D_1$ for the opening 214 to align with an opening 218 in the housing 206. Further, a flexible bracket or mount 220 may be rigidly secured to the spring 210 below an opening 218. The upper wall of the flexible bracket 220 in these embodiments defines the floor of the cage 216.

With continued reference to FIG. 9, the housing 206 may include another opening 230 to accept a fastener 232 which may be an externally threaded fastener such as a screw or a bolt. In an embodiment, a head 234 of the fastener 232 is elongated to provide better guidance to the force a technician applies to the spring 210. The fastener 232 may be coupled to the spring 210 via an internally threaded opening 236.

To engage the spring clamp 202, a technician applies pressure to the fastener 232 to align the opening 214 with the opening 218, and pushes an end of a wire into the cage 216. Because of the shape of the spring 210, some of the pressure the fastener 232 communicates to the spring 210 at the opening 236 is directed at the inclined wall 212. As a result, the technician must exert greater pressure to align the openings 214 as 218 as compared to the embodiment of FIGS. 6-8 (assuming the springs 154 and 210 have similar composition and thickness). Moreover, the pressure applied to the fastener 232 must be sufficient to deflect or bend the upper section of the bracket 220 toward the opening 218. In other words, the bias in the direction $D_2$ provides better guidance to pressure applied to the fastener 232. Once the technician stops applying the requisite amount of pressure to the fastener 232, the spring 210 clamps the wire between the housing 206 and the upper section of the bracket 220.

To also engage the screw clamp 204, the technician may thread the fastener 232 which may be a screw, for example. The screw clamp 204 may clamp the wire between a work end 240 of the fastener 232 and the upper section of the bracket 220. In at least some of the embodiments, the tail of the spring 210 may also bend toward the upper section of the bracket 220 if the technician continues to thread the fastener 232 after the work end 240 reaches the upper section of the bracket 220. Although the use of the screw clamp 204 is optional, the terminal wire block 200 may provide a secure and reliable wire contact by clamping the wire with both the spring clamp 202 and the wire clamp 204. Similar to the terminal wire block 150, the terminal wire block 200 releases the wire if the fastener 232 is loosened, and sufficient pressure is applied to the fastener 232 in the direction opposite to $D_1$.

In some embodiments, the base 206 may be soldered to a circuit board. If desired, one or several contacts 244 may extend or be soldered to the lower portion of the bracket 220 to provide an easily detachable connection to a wiring board.

In an embodiment suitable for use with wires that carry 4-20 mA signals in a process control environment, for example, the spring 210 may be made of beryllium copper and have a thickness of approximately 0.457 mm (26 gauge). Further, the maximum stress of the spring 210 may be approximately 90% of yield. The initial preload at 1 mm nominal deflection may be 1.5 lbs, and the maximum load at full screw deflection may be 6.5 lbs. In other embodiments, it is also contemplated that stainless steel may be used to manufacture the spring 210. Further, the composition and thickness of the spring 154 (illustrated in FIGS. 6-8) may be similar to the composition and thickness of the spring 210.

Now referring to FIG. 10, a multiple-input wire connector 300 includes two terminal wire blocks 302 and 304 identical or similar to the terminal wire block 200 disposed at the upper and lower levels of the wire connector 300, respectively. The elevation of the terminal wire block 302 relative to the terminal wire block 304 provides convenient access to each of the terminal blocks 302 and 304. In this embodiment, the terminal wire blocks 302 and 304 may share a common housing 310 to simplify the process of manufacturing and assembly of the wire connector 300. Further, similar to the multiple-input wire connector 100 illustrated in FIG. 5, the wire connector 300 may include multiple terminal wire blocks on each of the upper and lower levels. As illustrated in FIG. 10, the wire connector 300 may be mountable on a circuit or wire board, for example, and may engage the corresponding electrical contacts via pairs of connectors 312 and 314. If desired, it is possible to manufacture the wire connector 300 with a small foot print. In one embodiment, for example, the height and the length of the wire connector 300 is approximately 36 mm and 30 mm, respectively, with a thickness of each pair of terminals blocks 302 and 304 of approximately 6.35 mm.

From the foregoing, it will be appreciated that the terminal wire block 10, 150, or 200, as well as the multiple-input connector 100 or 300, addresses individual preferences of technicians by providing independently operable wire clamps implementing different wire clamping techniques. When using the terminal wire block 10 or the multiple-input connector 100, for example, a technician need not necessarily use a screwdriver or another tool or, conversely, the technician may choose not to engage the push-in contact of the spring clamp 14 if the push button 34 is hard to reach, for example. Moreover, the technician may also choose to provide additional contact integrity by securing the wire 12 using both the spring clamp 14 and the screw clamp 16. On the other hand, the terminal wire block 150 or 200 allows a technician to engage the spring clamp 152 or 202 alone, or together with the corresponding screw clamp 156, using a single tool such as a screwdriver.

While the present system and methods have been described with reference to specific examples, which are intended to be illustrative only and not to be limiting of the disclosure, it will be apparent to those of ordinary skill in the art that changes, additions and/or deletions may be made to the disclosed embodiments without departing from the spirit and scope of the disclosure.

What is claimed is:

1. A terminal wire block for use with an electrical wire, comprising:

a spring clamp including:

a cage having an opening and an inner wall to receive the electrical wire through the opening; and a biasing element biased so as to secure the electrical wire in a fixed position when the electrical wire is inside the cage; and a screw clamp including a fastener with an external threaded surface to secure the electrical wire in the fixed position in response to tightening of the fastener; wherein at least one of the spring clamp and the screw clamp is adapted to secure the electrical wire independently of the other one of the spring clamp and the screw clamp.

2. The terminal wire block of claim 1, wherein the biasing element is a flexible spring finger.

3. The terminal wire block of claim 2, wherein the flexible spring finger is conductive.

4. The terminal wire block of claim 1, wherein the cage is a first cage; and wherein the screw clamp further includes a second cage with an internal wall and an internally threaded opening to mate with the fastener, and wherein the fastener forces the electrical wire against the internal wall of the second cage when actuated.

5. The terminal wire block of claim 1, further comprising a push button to force the biasing element away from the inner wall of the cage, so that the electrical wire is released from the spring clamp in response to the push button being pushed.

6. The terminal wire block of claim 1, further comprising an opening to receive the electrical wire; wherein the screw clamp is positioned between the opening and the spring clamp so that the electrical wire passes through the screw clamp to reach the spring clamp.

7. The terminal wire block of claim 1, wherein the cage is further associated with the screw clamp, and wherein the electrical wire is forced against the inner wall of the cage in response to tightening of the fastener.

8. The terminal wire block of claim 1, wherein the cage is further associated with the screw clamp, and wherein the screw clamp causes the cage to contract in response to tightening of the fastener.

9. The terminal wire block of claim 1, wherein the fastener is operatively coupled to the biasing element to deflect the biasing element and release the electrical wire from the spring clamp in response to pressure being applied to the fastener.

10. The terminal wire block of claim 1, wherein the biasing element is biased against the inner wall of the cage in a first direction; and wherein the biasing element is further biased in a second direction approximately perpendicular to the first direction.

11. The terminal wire block of claim 1, wherein the opening is a first opening; the terminal wire block further comprising:

a housing having an inclined wall with a second opening; wherein the first opening becomes aligned with the second opening to receive the electrical wire through the first opening and the second opening when pressure is applied to the biasing element.

12. The terminal wire block of claim 11, wherein the biasing element is further biased against the inclined wall.

13. A terminal wire block for use with a wire, comprising:

a first clamp to secure the wire in a fixed position; and a second clamp to secure the wire in the fixed position; wherein at least one of the first clamp and the second clamp is adapted to secure the wire independently of the other one of the first clamp and the second clamp, wherein at least one of the first clamp and the second clamp is independently operable, and wherein the first clamp and the second clamp implement different clamping techniques.

14. The terminal wire block of claim 13, wherein the first clamp is a spring clamp having a biasing element to implement a push-in contact, and wherein the second clamp is screw clamp having an externally threaded fastener.

15. The terminal wire block of claim 14, further comprising a push button to release the wire from the spring clamp in response to the push button being pushed.

16. The terminal wire block of claim 14, wherein the fastener is operatively connected to the biasing element to release the wire from the spring clamp in response to pressure applied to the fastener.

17. The terminal wire block of claim 13, wherein each of the first clamp and the second clamp is adapted to secure the wire independently of the other one of the first clamp and the second clamp, wherein each of the first clamp and the second clamp is independently operable.

18. A terminal wire block for use with a wire, comprising:
a cage including:
an inner wall; and
an opening to receive the wire;
a biasing element biased so as to secure the wire in a fixed position when the wire is placed inside the cage; and
a fastener to secure the wire in the fixed position independently of the biasing element.

19. The terminal wire block of claim 18, wherein the biasing element is biased toward the inner wall of the cage.

20. The terminal wire block of claim 18, wherein the fastener is operatively connected to a bracket having an inner wall, so that the fastener forces the wire against the inner wall of the bracket when actuated.

21. The terminal wire block of claim 20, wherein the cage is a first cage; and wherein the terminal wire block further comprises a second cage including the bracket, wherein the second cage is disposed in front of the first cage so that the terminal wire block receives the wire in the second cage prior to receiving the wire in the first cage.

22. The terminal wire block of claim 18, wherein the biasing element is a flexible spring finger.

23. The terminal wire block of claim 18, wherein the biasing element is a spring having a first bias and a second bias approximately perpendicular to the first bias.

24. The terminal wire block of claim 18, wherein the fastener includes an external threaded surface.

25. The terminal wire block of claim 18, further comprising a push button to actuate the biasing element.

26. The terminal wire block of claim 25, wherein the wire is released from the cage in response to the push button being pushed.

27. The terminal wire block of claim 18, further comprising a terminal base to connect the terminal wire block to a circuit board.

28. An array of terminal wire blocks defining a multiple-input connector, comprising:
a front row including a first plurality of terminal wire blocks;
a back row including a second plurality of terminal wire blocks; wherein the back row is elevated relative to the front row; and wherein each of the first plurality of terminal wire blocks and the second plurality of terminal wire blocks includes:
a first clamp to secure a respective wire in a fixed position; and
a second clamp to secure the respective wire in the fixed position;
wherein at least one of the first clamp and the second clamp is adapted to secure the wire independently of the other one of the first clamp and the second clamp, wherein at least one of the first clamp and the second clamp is independently operable, and wherein the first clamp and the second clamp implement different clamping techniques.

29. A terminal wire block for use with an electrical wire, comprising:
a housing having a first opening to receive the electrical wire;
a spring clamp disposed inside the housing, the spring clamp including:
a cage having a second opening to receive the end of the electrical wire through the first opening; and
a flat spring biased so as to secure the electrical wire in a fixed position when the electrical wire is inside the cage; wherein
the flat spring is shaped so as to define the cage; and
a screw clamp disposed inside the housing, the screw clamp including a fastener with an external threaded surface to secure the electrical wire in the fixed position in response to tightening of the fastener; wherein
the fastener is operatively connected to the biasing element, so that the first opening becomes aligned with the second opening to receive the electrical wire through the first opening and the second opening in response to pressure being applied to the fastener.

30. The terminal wire block of claim 29, wherein the flat spring includes:
a first bias directed approximately against a direction in which the fastener applies pressure to the flat spring; and
a second bias approximately perpendicular to the first bias.

31. The terminal wire block of claim 29, wherein the housing includes an inclined wall; and wherein
the flat spring includes a section parallel to the inclined wall.

* * * * *

UNITED STATES PATENT AND TRADEMARK OFFICE

CERTIFICATE OF CORRECTION

PATENT NO. : 7,909,633 B1
APPLICATION NO. : 12/560300
DATED : March 22, 2011
INVENTOR(S) : Arlyn E. Miller et al.

It is certified that error appears in the above-identified patent and that said Letters Patent is hereby corrected as shown below:

At Column 4, line 29, “may also may be” should be -- also may be --.

Signed and Sealed this
Twenty-eighth Day of February, 2012

David J. Kappos

David J. Kappos
*Director of the United States Patent and Trademark Office*